United States Patent [19]

Shamie

[11] Patent Number: 4,530,528

[45] Date of Patent: Jul. 23, 1985

[54] DOUBLE ACTION CRIB DROP SIDE LOCK

[76] Inventor: Louis Shamie, 630 Ave. V, Brooklyn, N.Y. 11223

[21] Appl. No.: 468,359

[22] Filed: Feb. 22, 1983

[51] Int. Cl.[3] ..... E05C 5/02

[52] U.S. Cl. ..... 292/60; 5/100

[58] Field of Search ..... 292/57–60, 292/305, 306, 62; 5/100; 411/349; 248/222.3

[56] References Cited

U.S. PATENT DOCUMENTS

| | | | |
|---|---|---|---|
| 1,040,963 | 10/1912 | Strong et al. | 292/57 X |
| 1,396,205 | 11/1921 | Hill et al. | 292/60 |
| 1,605,883 | 11/1926 | Wheelock | 292/58 X |
| 2,514,668 | 7/1950 | Neunherz | 5/100 |
| 2,804,631 | 9/1957 | Levin | 5/100 |
| 3,641,598 | 2/1972 | Feldstein | 5/100 |
| 3,896,514 | 7/1975 | Feldstein | 5/100 |
| 3,911,510 | 10/1975 | Bryant | 5/100 |
| 4,138,150 | 2/1979 | Bills | 292/60 |

*Primary Examiner*—Gary L. Smith
*Assistant Examiner*—Thomas J. Dubnicka
*Attorney, Agent, or Firm*—McGlew and Tuttle

[57] ABSTRACT

A double action securing device for the drop side of a crib comprises a guide member connected to the crib or to the drop side in a vertically oriented position. A slide member is slidably mounted to the guide member between two positions for raising and lowering the drop side. A catch pin is axially and rotatably mounted to the slide member and engageable with an opening of the guide member in at least one of the relative positions. The catch pin has a head which defines a recess for embracing a lower edge of the guide member opening. The weight of the slide member causes the head recess to drop over the lower edge of the opening to lock the slide member with respect to the guide member. The catch pin can further be rotated to increase the engagement. A disengagement or unlocking of the slide member from the guide member thus requires at least two distinct movements, one for raising the catch pin and thus disengaging the head recess from the opening edge, and the other for axially withdrawing the catch pin head from the opening. When the catch pin is rotatable, a third motion is required to initially align the head with the opening, and thereafter lift and axially withdraw the head.

10 Claims, 8 Drawing Figures

FIG. 1
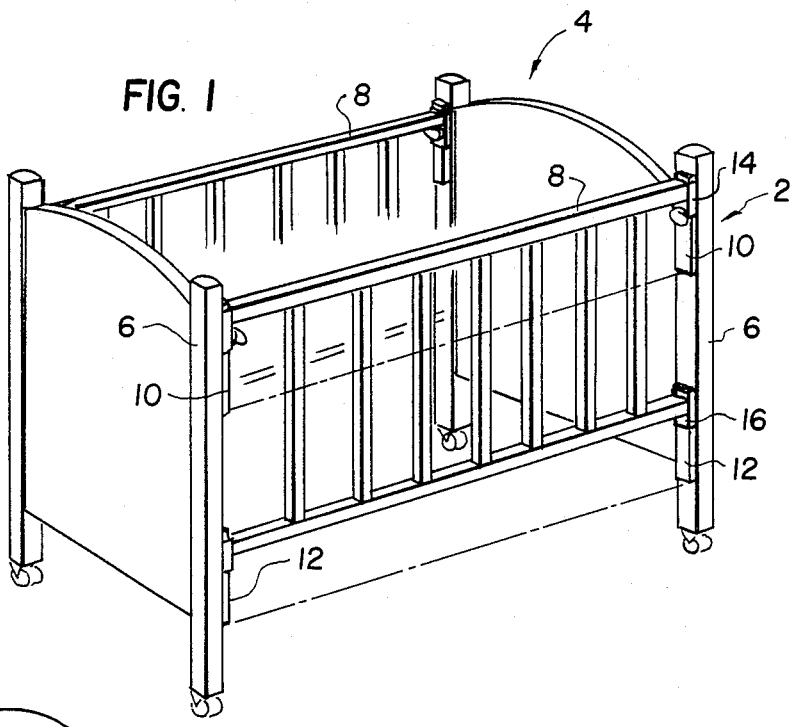
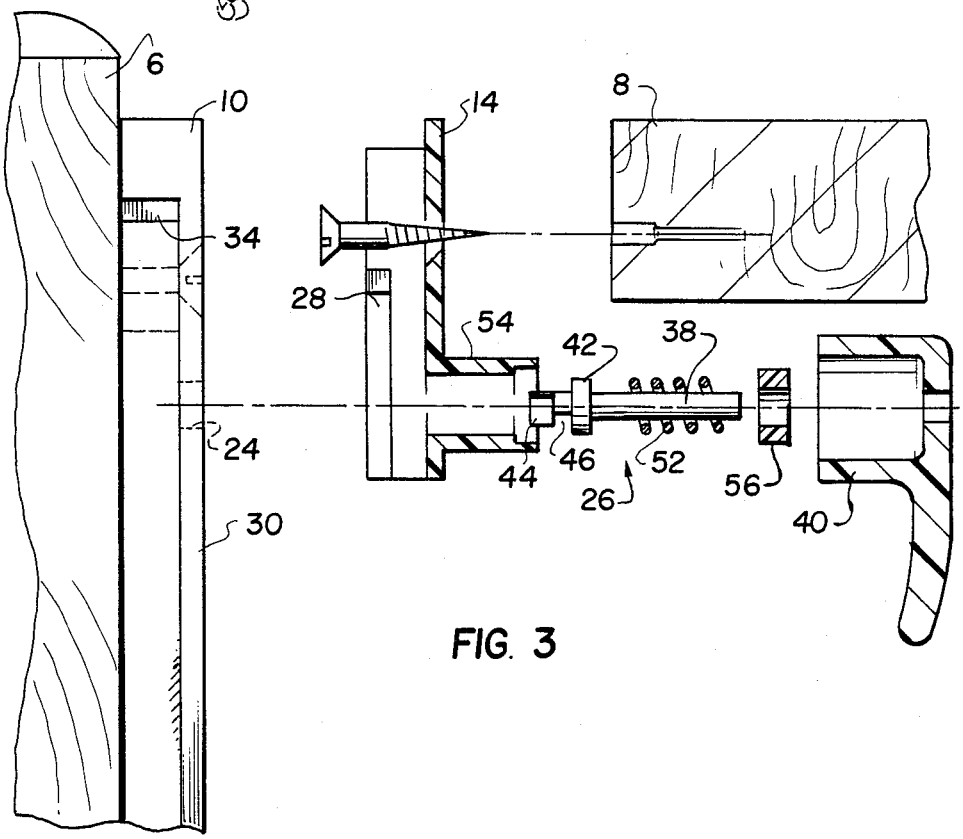
FIG. 3

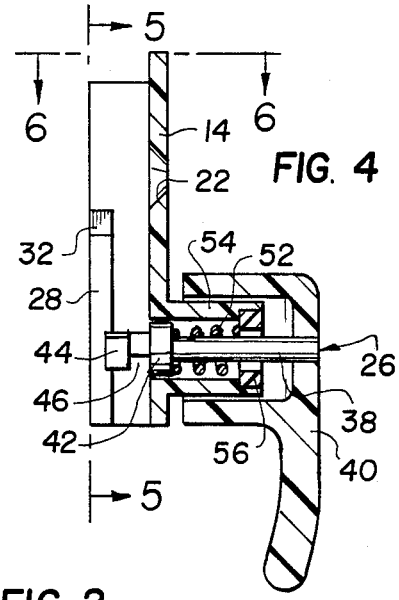
FIG. 4
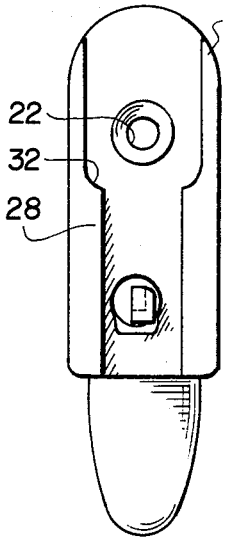
FIG. 5
FIG. 2
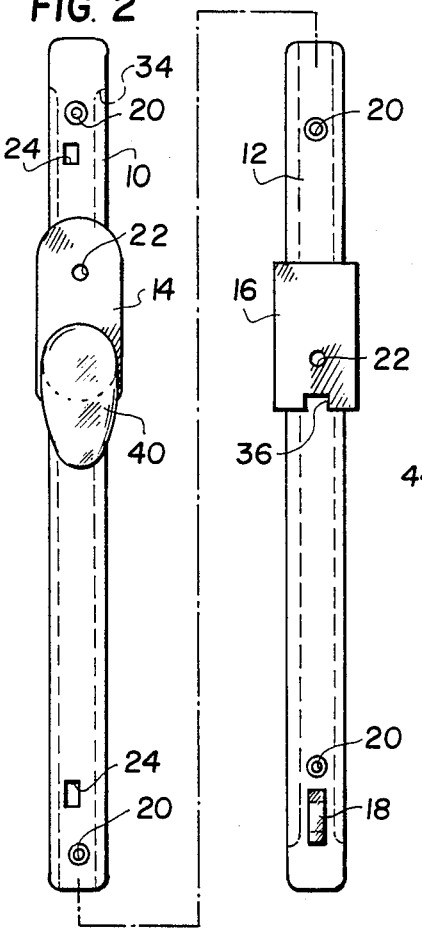
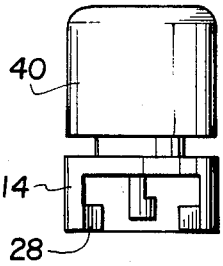
FIG. 6
FIG. 7
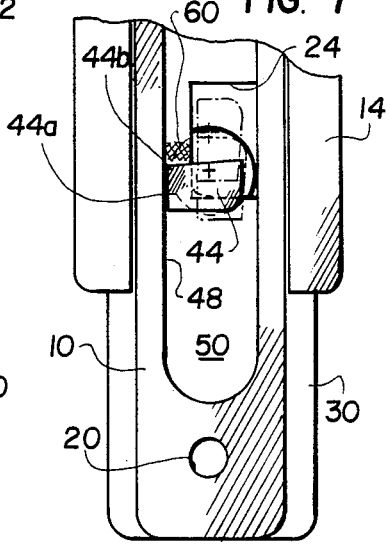
FIG. 8
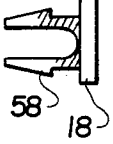

DOUBLE ACTION CRIB DROP SIDE LOCK

FIELD AND BACKGROUND OF THE INVENTION

The present invention relates in general to cribs and in particular to a new and useful double action securing device for locking the drop side of a crib in a raised or lowered position.

Cribs which include drop sides or gates are well known. Mechanisms must be provided for locking the drop sides of cribs in their respective raised or lowered positions. Since infants are involved, extra safety precautions must also be taken to ensure that the drop side, once locked in its raised position, will not inadvertently become unlocked and thus accidentally fall. To preclude such inadvertent unlocking, the use of double action mechanisms are highly desirable. Legislation has even been proposed for mandating such double action mechanisms in all infant related products.

A double action securing mechanism for the drop side of a crib has already been disclosed in U.S. Pat. No. 3,896,514 to Feldstein. In this patent, T-shaped guides are connected to the frame members of a crib. Slides connected to the drop side of the crib are slidably mounted to the guides. A knob with an internal helical surface is mated with a post having an external helical surface connected to the slide. A pin with a head member is connected to the knob and axially movable into a key hole shaped opening in the guide, disposed at desired upper and lower positions for the drop sides. Rotation of the knob with the head extending into the keyhole opening causes firm engagement of the head against an interior surface of the guide to firmly lock the slide with respect to the guide.

While this structure is effective in establishing a double action locking engagement between the drop side and the crib frame, improvements can be made toward simplifying the arrangement and increasing its durability and ease of operation.

SUMMARY OF THE INVENTION

The present invention is drawn to a double action securing device for the drop side of a crib which utilizes a catch pin having a head defining a recess which is engageable in the opening of a guide member. The pin recess drops over a lower edge of the opening under the weight of a slide member and connected structure to which the pin is mounted. A double action requirement for unlocking the device is thus automatically established in that the slide member must first be raised with respect to the guide member and catch pin then axially withdrawn from the guide opening before the mechanism is disengaged. The guide member is connected either to the crib frame or to the drop side, with the slide member and its related parts connected to the drop side or crib frame respectively.

Accordingly, an object of the present invention is to provide a double action securing device for the drop side of a crib, comprising a guide member having an opening therein with a lowered edge and adapted to be connected to one of the drop side and crib, a slide member slidably mounted to the guide member for relative movement between raised and lowered positions with respect to the guide member, the slide member adapted to be connected to the other of the drop side in the crib, and a catch pin axially mounted to the slide member, having a head defining a recess, with the head being of a size to pass into the opening and the opening positioned on the slide member for receiving the hole in one of the raised and lowered relative positions.

A further object of the invention is to provide such a double action securing device wherein the catch pin is rotatably mounted to the slide member and the head has a shape so that it can be withdrawn from the guide member opening only at one relative rotational position between the catch pin and the guide member. The catch pin can thus be rotated to block axial movement of the head out of the guide member opening. A triple action motion is then required to unlock the slide member from the guide member.

A still further object of the invention is to provide a double action securing device for the drop side of a crib which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and decriptive matter in which a preferred embodiment of the invention is illustrated.

BRIEF DESCRIPTION OF THE DRAWINGS

In the drawings:

FIG. 1 is a perspective view of a crib including crib frame and drop sides with the mattress and related mounting hardware removed for clarity;

FIG. 2 is a composite view showing the orientation of an upper guide member with locking slide member and a lower guide member with free sliding slide member;

FIG. 3 is an enlarged, partial exploded view of the securing device with portions shown in section;

FIG. 4 is a sectional view of the assembled slide member in accordance with the invention;

FIG. 5 is a bottom plane view taken along the lines 5—5 of FIG. 4;

FIG. 6 is a top plan view taken along the lines 6—6 of FIG. 4;

FIG. 7 is a partial further enlarged bottom plan view of the guide member with engaged slide member; and FIG. 8 is a side elevational view of a stop member for establishing a lower position of the drop side.

DESCRIPTION OF THE PREFERRED EMBODIMENT

Referring to the drawings in particular the invention embodied therein, as illustrated in FIG. 1, comprises a double action securing device generally designated 2 for a crib 4 having frame members 6 and vertically movable drop sides or gates 8.

Upper and lower guide members 10,12 are connected to each frame member 6 for slidably receiving upper and lower slide members 14, 16. The slide members are connected to the upper and lower cross beams of drop sides 8 to permit vertical movement of the drop sides with respect to the crib frame.

Each lower slide member 16 is freely slidable on its guide member 12 and restricted only from movement off the lower end of slide 12 by a stop member 18 shown in FIGS. 2 and 8.

Upper slide member 14 includes a double action locking arrangement illustrated in FIGS. 3 through 6, which is capable of locking the drop side in its raised and lowered positions.

As shown in FIG. 2, countersunk holes 20 are provided in the upper and lower guide members 10,12 for admitting wood screws to connect the slides to the frame members 6. Countersunk holes 22 are provided at the upper and lower slide members 14,16 for admitting wood screws to fasten the slide members to the cross beams of the drop sides 8.

As will be explained in greater detail hereinunder, upper and lower openings 24 are provided in upper guide member 10 for receiving the end of a catch pin generally designated 26 in FIG. 3. Openings 24 both have parallel side edges, a lower edge and an upper edge.

Referring now to FIGS. 3–6, slide member 14 is channel shaped and includes flanges 28 which embrace flanges 30 in upper guide member 10 which is thus T-shaped. Lower guide member 12 is similarly shaped with lower slide member 16 having substantially the same cross sectional shape as upper slide member 14.

Flanges 28 merge with the side walls of slide member 14 and establish a stopping bevel 32. As shown in FIG. 3 and in dotted line in FIG. 2, flanges 30 end in stop bevels 34 on guide member 10. Bevels 32,34 form a stop for the upper movement of slide member 14. Similar bevels are provided on lower guide and slide members 12,16. In general, the downward sliding movement of slide 16 is stopped earlier by stop 18 which engages a recess 36 in the bottom of slide 16. Recess 36 and stop 18 is positioned to properly align catch pin 26 with lower guide member opening 24. Bevels 32, 34 for the upper guide and slide members is similarly effective to stop the upward movement of upper slide 14 at a point where the catch pin 26 is aligned with upper guide member opening 24.

Catch pin 26 includes a small diameter shank 38 which has an end connected, for example by gluing or screwing, to an actuator knob 40. Shank 38 ends at a larger diameter inner head 42 to which is connected an outer head 44. As shown in FIG. 7, head 44 is substantially rectangular in shape and is smaller than opening 24. The position of head 44 shown in solid line illustrates the triple locked position thereof wherein a recess 46 defined by head 44 has engaged over a lower edge opening 24, and pin 26 has been rotated about 90° in a clockwise direction as viewed in FIG. 7, to move an end 44*a* of head 44 out beyond a side edge of opening 24. End 44*a* of head 44 may also include a corner 44*b* positioned to just scrape against an interior surface 48 of a channel 50 defined in the bottom of guide member 10, as head 44 is rotated into its solid line position. This further secures catch pin 26 in its locked position.

Rotation of knob 40 in a counterclockwise direction as viewed from FIG. 7 brings head 44 into its dash double dot position. Slide 14 is then lifted to bring head 44 into its dash dot position. Thereafter, knob 40 can be withdrawn against the bias of a spring 52 to withdraw head 44 clear of opening 42 and permit vertical sliding of slide member 14 on guide 10.

Slide 14 includes a cylindrical post 54 with a through opening for receiving pin 26. A stop washer or retainer 56 is press fit or glued into the end of post 54 to confine spring 52, which bears against washer 56 and inner head 42. At abutting surface of inner head 42 which communicates with recess 46 engages on the outer casing surface of guide member 10 to limit the inward relative movement of catch pin 26 with respect to guide member 10. As shown in FIG. 7, inner head 42 is of a size and configuration to preclude its entry into opening 24.

As shown in FIG. 8, stop member 18 has flexible legs 58 which can be squeezed together to enter a suitably provided rectangular slot in lower guide member 12, and retains stop 18 therein.

With the exception of pin 26 and spring 52, virtually all the parts can be made of plastic or other suitable material. Spring 52 and pin 26 is preferably made of metal for strength but can also be made of nylon or any other material having sufficient strength.

While guide members 10,12 are shown connected to the frame 6, the position of the slides and guides can be reversed, with appropriate modifications to the structure, for example a lengthening of catch pin 26 which may now extend through the frame members 6 to engage openings 24 of a slide connected to the drop sides 8.

A raised area 60 may also be provided on the base of channel 50 just above end 44*a*, so that with the head 44 in its solid line position in FIG. 7, slide 14 cannot be raised at all with respect to guide 10.

While a specific embodiment of the invention has been shown and described in detail to illustrate the application of the principles of the invention, it will be understood that the invention may be embodied otherwise without departing from such principles.

What is claimed is:

1. A double action securing device for the drop side of a crib, comprising:

a guide member (10) having an opening (24) therein with a lower edge and parallel side edges, said guide member adapted to be connected to one of the drop side and crib;

a slide member (14) slidably mounted to said guide member for relative movement between a raised and lowered position with respect to said guide member, said slide member adapted to be connected to the other of the drop side and crib;

a catch pin (26) rotatably and axially mounted to said slide member, said catch pin having a substantially rectangular head (44) defining a recess (46), said head being of a size to pass into said guide member opening (24) and said opening positioned on said guide member to receive said head in one of said raised and lowered positions, with said recess receiving said opening lower edge to lock said slide member to said guide member and so that said slide member can be unlocked from said guide member by first rotating said catch pin, then raising said slide member to withdraw said opening lower edge from said head recess and then axially withdrawing said head from said guide member opening, said head having an end portion (44*a*) adjacent said head recess which extends beyond said guide member opening, over one side edge of said guide member opening with rotation of said catch pin, said end portion having a flat edge and said substantially rectangular head (44) having a rounded corner diagonally from said first mentioned corner (44*b*), said first mentioned head of said catch pin comprising an outer head (44), said catch pin including an inner head (42) having a shape which precludes entry of said inner head into said guide member (24) opening for bearing against a surface of said guide member and defining a portion of said recess;

said guide member having a raised surface (60) adjacent said opening thereof and above said end portion (44*a*) of said catch pin head with said catch pin rotated so that upward sliding movement of said slide member with respect to said guide member is precluded;

said end portion (44*a*) of said catch pin head (44) includes a corner (44*b*), said guide member including a surface (48) adjacent said opening against which said corner is engageable with rotation of said catch pin for providing a friction locking between said catch pin head and said guide member, with said flat edge being parallel to said surface (48);

said slide member (14) includes a cylindrical post (54), said catch pin (26) extending axially through said post, a retainer (56) connected to said post and embracing said catch pin; and biasing means comprising a spring (52) extending in said post and axially around said catch pin and engaged against said inner head (42) and said retainer (56) for biasing said catch pin inner head axially toward said guide member with respect to said slide member.

2. A device according to claim 1, including an actuating knob (40) connected to an end of said catch pin (26) extending out of said post (54) in a direction away from said guide member (14).

3. A device according to claim 1, wherein said guide member has flanges (30), said slide member being channel shaped and having flanges (28) which embrace said flanges of said guide member for sliding movement of said slide member with respect to said guide member.

4. A device according to claim 3, wherein said guide member flanges (30) end in a beveled stop (34) against which flanges (28) of said slide member (14) abut to slide upward relative movement of said stop member with respect to said guide member (10).

5. A device according to claim 4, wherein said beveled stops are located to stop an upward movement of said slide member with respect to said guide member at a point of alignment between said catch pin (26) and said guide member opening (24).

6. A device according to claim 1, wherein said guide member (10) includes one additional opening (24) spaced from said first mentioned opening (24) for establishing the other of said raised and lowered positions.

7. A device according to claim 6, wherein said first mentioned and additional openings are rectangular, said catch pin head (44) being of a size smaller than said guide member openings (24,24), said head including said end portion (44*a*) which extends laterally of each guide member opening side edge and lower edge with said head extending in said opening and said catch pin (26) rotated with respect to said slide member (14) to lock said catch pin on said guide member.

8. A device according to claim 7, wherein said catch pin includes an actuating knob (40) having a portion extending around said post (54) and a portion extending laterally of said post, said laterally extending portion of said knob extending vertically with said catch pin rotated to unlock said catch pin from said guide member and horizontally, transverse to a longitudinal axis of said guide member (10) when said catch pin is locked to said guide member opening.

9. A device according to claim 8, wherein said catch pin includes a shank (38) connected between said knob (40) and said inner head (42), said spring (52) comprising a coil spring engaged around said shank between said inner head and said retainer (56).

10. A device according to claim 9, wherein said inner head (42) is cylindrical and concentric with said shank (38), a diameter of said inner head (42) being greater than a distance between said parallel side edges of said guide member opening (24).

* * * * *